US005351956A

United States Patent [19]

Kershner

[11] Patent Number: 5,351,956

[45] Date of Patent: Oct. 4, 1994

[54] GAME APPARATUS

[75] Inventor: Ellsworth S. Kershner, Philadelphia, Pa.

[73] Assignee: R. M. & G. Products, Inc., Brunswick, Ohio

[21] Appl. No.: 138,398

[22] Filed: Oct. 18, 1993

[51] Int. Cl.[5] ..... A63F 9/00

[52] U.S. Cl. ..... 273/153 R; 273/440

[58] Field of Search ..... 273/440, 447, 457, 458, 273/459, 317, 318, 153 R

[56] References Cited

U.S. PATENT DOCUMENTS

| | | | |
|---|---|---|---|
| 584,967 | 6/1897 | Strong | 273/328 |
| 714,421 | 11/1902 | Willey | 273/328 |
| 753,831 | 3/1904 | Munro | 273/328 |
| 858,712 | 7/1907 | Fulkerson | 273/328 |
| 1,516,918 | 11/1924 | Goldback | 273/328 |
| 1,636,216 | 7/1927 | Cornell | 273/153 R |
| 2,196,429 | 4/1940 | Siciliano | 273/328 |
| 2,813,720 | 11/1957 | Bascle | 273/109 X |
| 3,680,864 | 8/1972 | Peterson | 273/110 |
| 3,716,233 | 2/1973 | Kotwas et al. | 273/457 X |
| 3,980,306 | 9/1976 | Tollefson | 273/109 |
| 4,084,820 | 4/1978 | Olson, Jr. | 273/324 |
| 4,133,526 | 1/1979 | Anson | 273/441 |

FOREIGN PATENT DOCUMENTS

| | | | |
|---|---|---|---|
| 21572 | of 1891 | United Kingdom | 273/153 R |

*Primary Examiner*—William H. Grieb

*Attorney, Agent, or Firm*—Fay, Sharpe, Beall, Fagan, Minnich & McKee

[57] ABSTRACT

A game apparatus includes a housing enclosing a cavity in which is mounted support member, such as a golf tee, and an object, such as a golf ball. The diameter of the golf ball is greater than the maximum distance between the golf tee and a sidewall of the housing. Moreover, selected walls or portions of the housing may be formed of transparent material to limit a game player view of the cavity.

6 Claims, 4 Drawing Sheets

GAME APPARATUS

BACKGROUND OF THE INVENTION

This invention pertains to the art of novelty devices and more particularly to a game of skill and chance. The invention is particularly applicable to a housing having a cavity in which a golf tee is mounted. A golf ball is also disposed in the cavity and the goal of the game is to seat or position the ball on the tee by manipulating the housing. However, it will be appreciated that the invention need not be limited to a golf ball and tee (although that embodiment has particular appeal to golfers) and may employ similar structural arrangements that achieve the same result.

A number of games of skill and chance are known in the art. In fact, some of these employ a cup-shaped receptacle disposed in a cavity in which the object of the game is to manipulate game pieces into the cup. Exemplary of these various games are the following:

U.S. Pat. No. 584,967—Strong
U.S. Pat. No. 714,421—Willey
U.S. Pat. No. 753,831—Munro
U.S. Pat. No. 858,712—Fulkerson
U.S. Pat. No. 1,516,918—Goldback
U.S. Pat. No. 1,636,216—Cornell
U.S. Pat. No. 2,196,429—Siciliano
U.S. Pat. No. 3,716,233—Kotwas, et al.
U.S. Pat. No. 2,813,720—Bascle
U.S. Pat. No. 3,680,864—Peterson
U.S. Pat. No. 3,980,306—Tollefson
U.S. Pat. No. 4,084,820—Olson, Jr.
U.S. Pat. No. 4,133,526—Anson

SUMMARY OF THE INVENTION

The present invention contemplates a new game, a preferred embodiment of which is particularly appealing to a golfer.

According to a more limited aspect of the invention, the new game includes a housing having an interior cavity that receives a support member therein. At least one end of the support member is spaced from the housing wall by a first predetermined dimension. An object is also received in the cavity and has a width dimension greater than the first predetermined dimension so that the object is either solely supported by the support member or supported by both the support member and the housing.

According to a more limited aspect of the invention, the support member is a golf tee generally aligned with a longitudinal axis of a cylindrical cavity.

According to yet another aspect of the invention, the object is a golf ball that may be selectively received on and solely supported by the tee, or alternatively is supported by the tee and the housing.

According to still another aspect of the invention, at least a sidewall of the housing is formed of a transparent material.

It is a principal object of the subject invention to provide a game that requires a player to position the golf ball on the tee, both of which are located in an enclosed cavity.

It is a further object of the invention to limit the size of the cavity to vary the difficulty or skill level required to place the golf ball on the tee.

Yet another object of the invention is to limit the amount of the housing which is transparent to vary the level of difficulty of the game.

Still other objects and advantages of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 1:
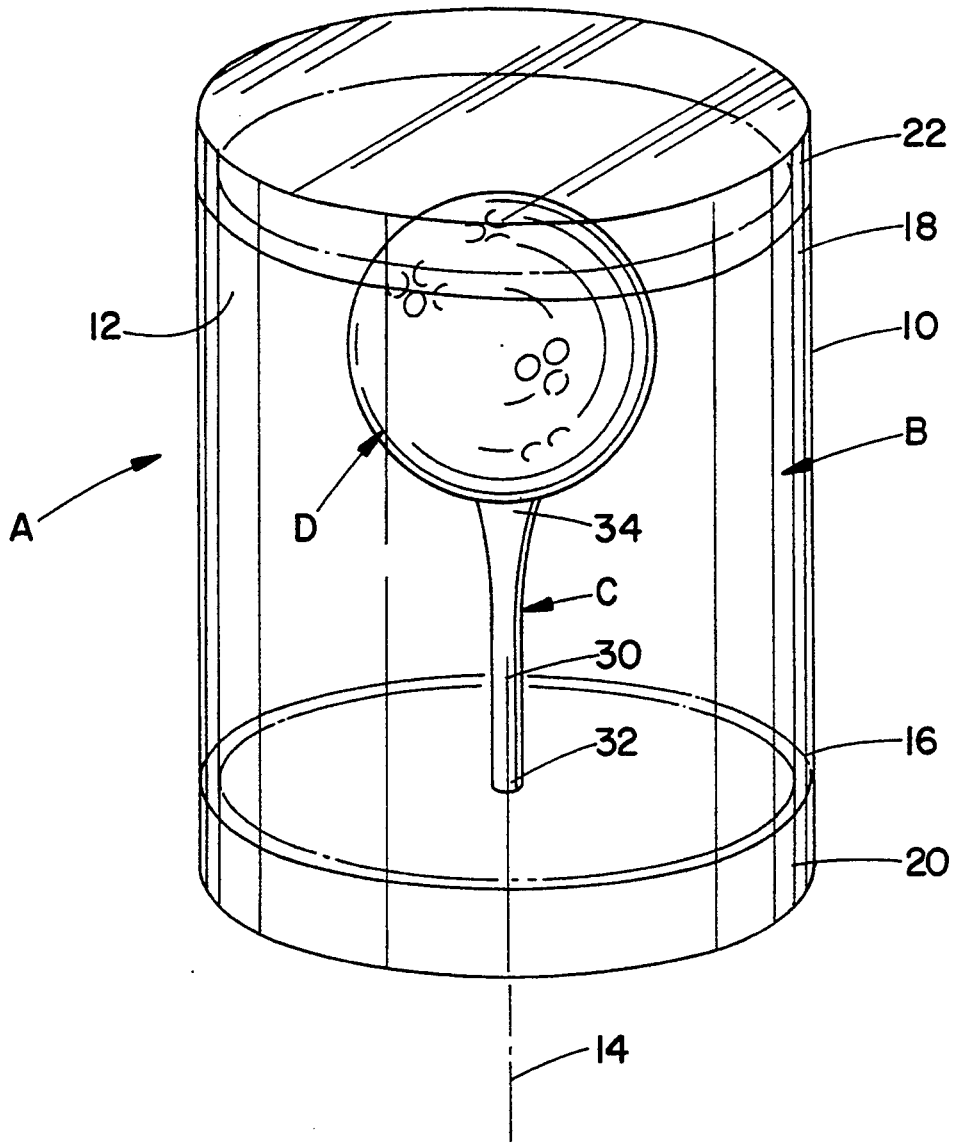
FIG. 1 is a perspective view of a first preferred embodiment of the subject new invention.
Figure 3:
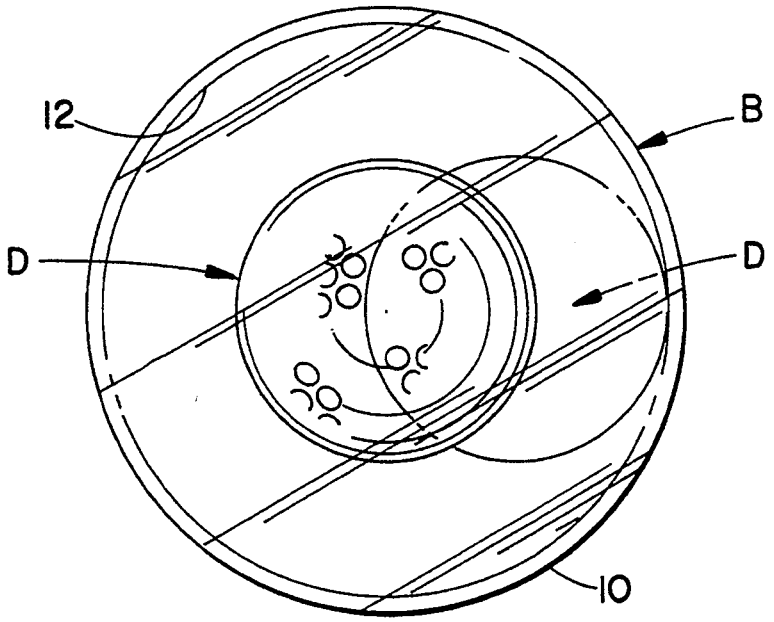
FIG. 3 is a top plan view of the FIG. 1 embodiment of the subject new invention.

Referring now to the drawings wherein the showings are for purposes of illustrating the preferred embodiments of the invention only, and not for purposes of limiting same, the FIGURES show a new game apparatus A preferably comprised of three major components, namely, a housing B, a support member C, and an object D. More particularly, and with reference to FIGS. 1–3, a first preferred embodiment of the game has a housing B defined by a generally cylindrical sidewall 10. The sidewall has a circular cross-sectional configuration (FIG. 3) that defines a cavity 12, which in this particular arrangement is an elongated cylindrical cavity 12. The cavity has a longitudinal axis 14 (FIG. 1) about which the sidewall is equispaced. First and second ends 16, be of the sidewall are closed by first and second end walls 20, 22. In this manner, the cavity is entirely closed from access by a user or player.

Substantially aligned with the longitudinal axis is the support member C. Although modified arrangement could locate the support member off axis relative to the longitudinal axis 14, it is generally desired to align the support member with the axis. In a preferred arrangement, the support member is defined by a golf tee 30. The tee is generally of conventional construction having an elongated configuration in which a first end 32 is secured in the first end wall 20 of the housing. A second end 34 of the tee includes a partially spherical recess 36 having a circular periphery that is adapted to support a golf ball in a well known manner. The circular periphery of the golf tee imposes an additional challenge to the game player attempting to position the golf ball on the tee. The second end 34 of the tee has a tapering configuration that increases in diameter from the remainder of the tee into a generally cylindrical portion that surrounds the spherical recess. Of course, still other support member configurations could be used with equal success and adapted to selectively receive the object D therein.

The object D freely received in the cavity is preferably a golf ball, although other articles such as a miniature basketball, baseball, soccer ball, etc. could be used without departing from the scope and intent of the subject invention. As shown, the golf ball has a representative dimple pattern, although other dimple patterns or smooth walled surfaces could be used. As will become more apparent from the description, the use of different patterns may be merely for aesthetic reasons or alternatively may impact on the level of difficulty associated with positioning the object on the support member.

Figure 2:
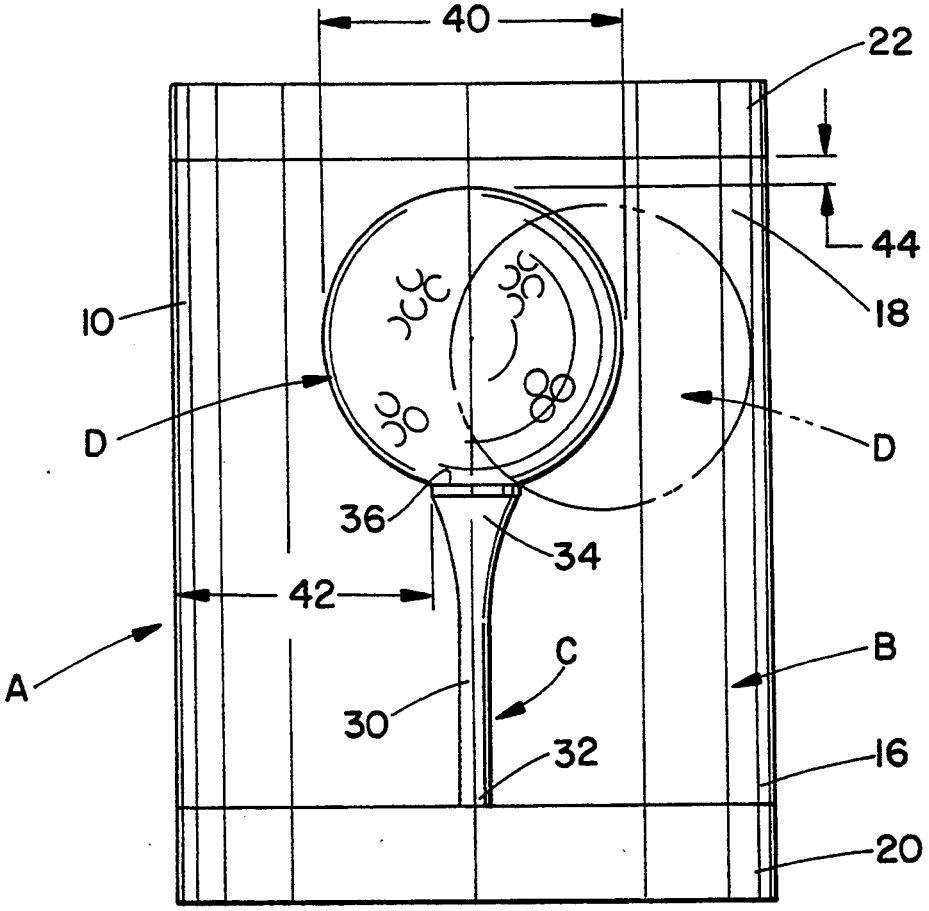
FIG. 2 is a side elevational view of the FIG. 1 embodiment showing the golf ball solely supported on the golf tee in solid line and partly supported by the golf tee and interior sidewall in phantom.
Figure 4:
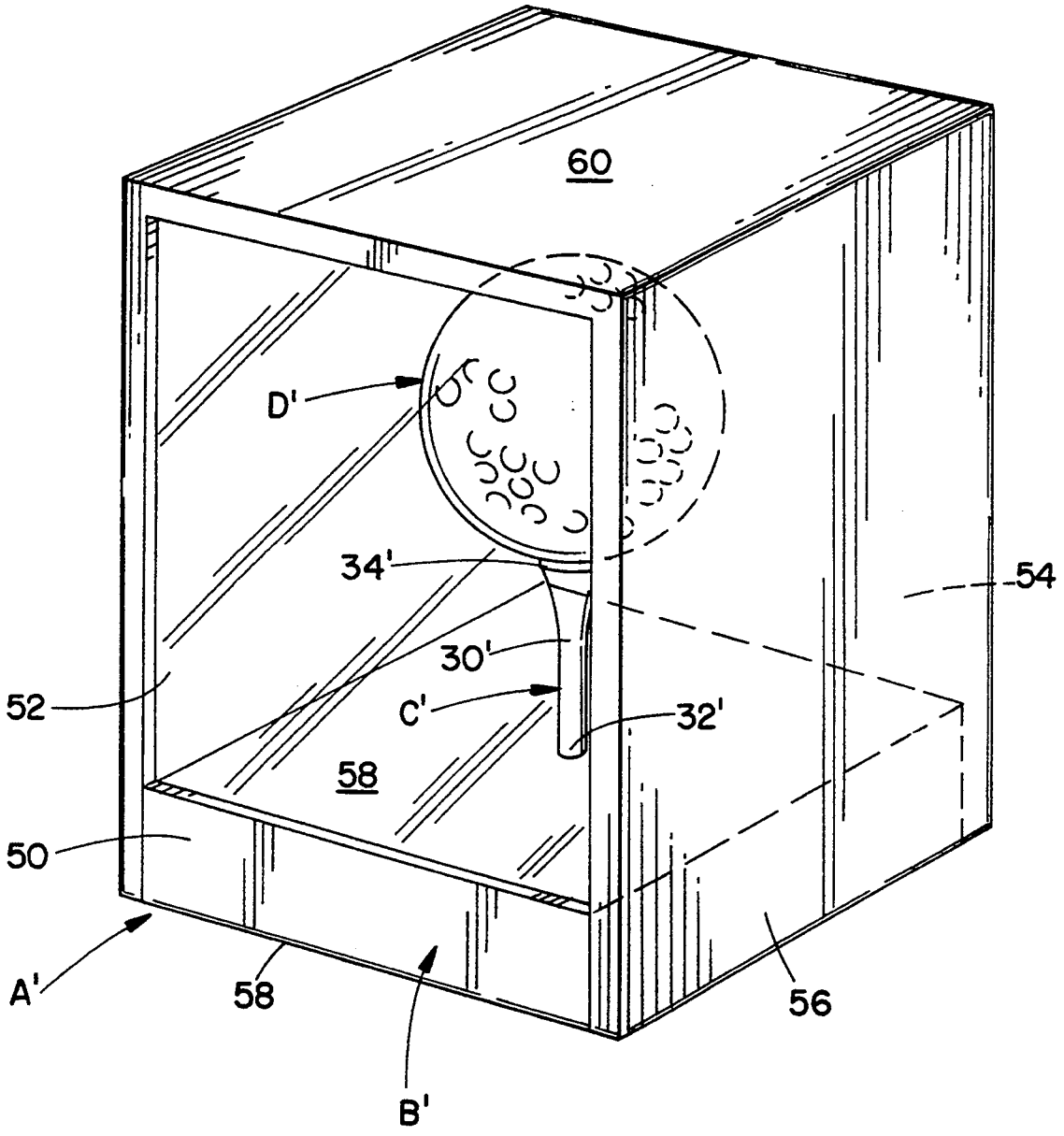
FIG. 4 is a perspective view of a second preferred embodiment of the subject invention.

The golf ball has a diameter 40 that is substantially greater than a first predetermined dimension 42 between the support member and the interior of the sidewall 10 of the housing (FIG. 2). This dimensional relationship is perhaps most easily seen and understood with reference to and comparison between the solid line and phantom representations of the golf ball in FIGS. 2 and 3. By incorporating this feature into the game, the golf ball will not fall below the second end 34 of the golf tee. Rather, if the ball is not solely supported on the tee, it will be partially supported on the rim of the tee and abuttingly supported by the sidewall 10 when the game is oriented in an upright fashion as shown.

Moreover, a second predetermined dimension 44 between the second end of the golf tee and the second end wall 22 provides some latitude in allowing a game player to attempt to position the ball on the spherical recess 36 of the tee. Thus, free movement of the ball in the cavity is limited to that volume or region defined above the support member, within the sidewall, and below the second end wall 22.

It will also be noted that in the preferred arrangement selected portions of the housing are transparent. In the illustrated embodiment of FIGS. 1–3, the sidewall be and second end wall 22 are both formed of a transparent material, such as a durable plastic. The first end wall 20 may be opaque, although it is contemplated that it may also be formed of a transparent material if so desired.

The second preferred embodiment of FIGS. 4–7 will now be described. For ease of reference, like elements will be identified by like numerals with a primed suffix (′) while new elements will be referred to by new numerals. The housing B′ has a six-sided, box-like configuration that encloses a cavity 12′. Particularly, four planar sidewall portions 50, 52, 54, 56 define the sidewall and cooperate with first and second end walls 58, 60 to enclose the cavity. Each of the sidewall portions and end walls preferably has a rectangular or square configuration, although other configurations could also be used.

Figure 7:
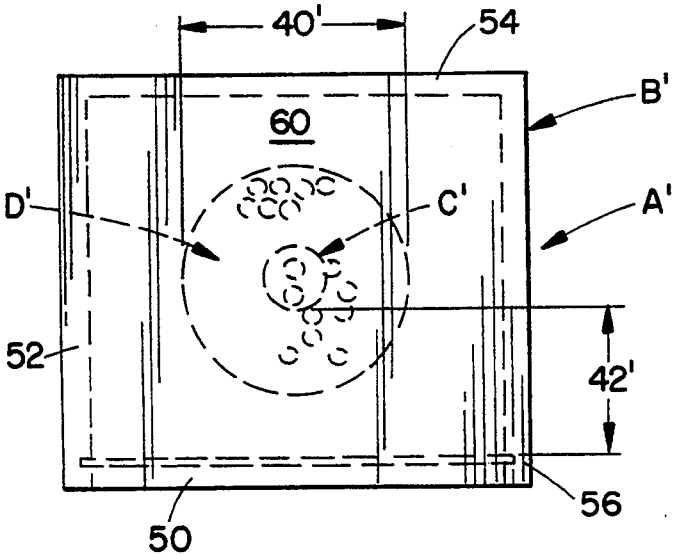
FIG. 7 is a top plan view of the FIG. 4 embodiment.
Figure 5:
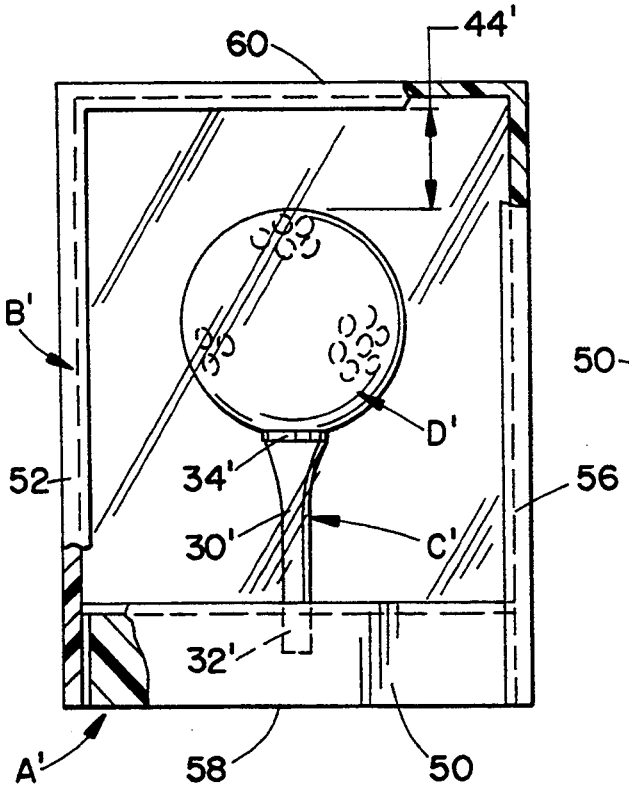
FIG. 5 is a front elevational view of the FIG. 4 embodiment.
Figure 6:
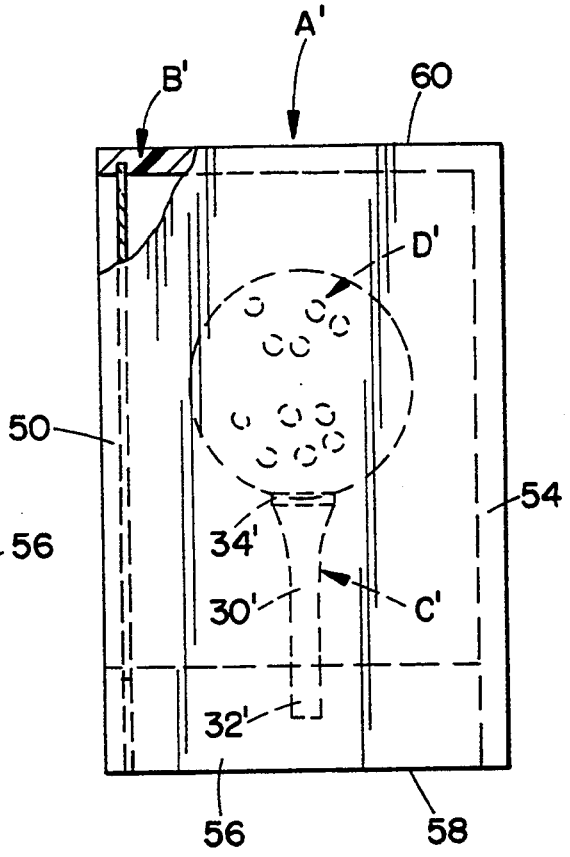
FIG. 6 is a side elevational view taken generally from the right-hand side of FIG. 5.

A central axis 14′ passes through the centers of the ends walls and the support member C′, defined by golf tee 30′, is substantially aligned along that axis. The first end 32 of the tee is secured in the first end wall 58 while the second end 34′ of the tee is spaced a predetermined dimension 44′ from the second end wall 60. As best shown in FIGS. 5–7, the golf tee is not equispaced from the sidewall, but the maximum dimension from the support member to any location along the sidewall is still less than the diameter of the golf ball. In this manner, movement of the golf ball is constrained to the region above the second end 34 of the golf tee, below the second end wall 60 and further constrained by the sidewall 50, 52, 54, and 56. As described above, these dimensions may vary as desired and to alter the level of difficulty in attempting to seat the golf ball on the recess 36′ of the tee through manipulation of the housing.

The second preferred embodiment further illustrates that selected portions of the housing can be made transparent or opaque. As shown, only sidewall portion 50 is formed of a transparent material. The remaining sidewall portions and both ends walls are formed of an opaque material so that the game player cannot directly view the cavity, tee, and ball except through the sidewall portion 50. This adds another dimension of difficulty to the game, which can differ depending on the number of sidewall portions or end walls that are formed from the transparent material. Moreover, it is contemplated that only portions of a selected wall may be formed of a transparent material, i.e., only a portion or window region in sidewall portion 50 or only a portion of end wall 60.

The invention has been described with reference to the preferred embodiments. Obviously, modifications and alterations will occur to others upon a reading and understanding of this specification. For example, the housing can have still other configurations such as forming the second end wall as a hemispherical dome, or adding extra tees or support members in spaced relation in the cavity at the same or different dimensions 42 or 44 from the sidewall(s) or second end wall. Moreover, the materials of construction of the various components can vary as desired. The invention is intended to include all such modifications and alterations insofar as they come within the scope of the appended claims or the equivalents thereof.

Having thus described the invention, it is claimed:

1. A game apparatus comprising:

a housing having a sidewall and first and second end walls at opposite ends thereof defining a cavity;

a golf tee extending from the first end wall toward the second end wall and being substantially aligned with a longitudinal axis of the cavity, the tee being spaced a first predetermined dimension from the sidewall; and a golf ball freely received in the cavity for selective support on the golf tee, the golf ball having a diameter greater than the first predetermined dimension to limit movement of the golf ball within the cavity.

2. The game apparatus as defined in claim 1 wherein at least the sidewall and the second end wall are formed of a transparent material.

3. The game apparatus as defined in claim 1 wherein the second end wall is spaced along the longitudinal axis from the second end of the tee a second predetermined dimension greater than the golf ball diameter.

4. The game apparatus as defined in claim 1 wherein a portion of the housing is formed of a transparent material.

5. The game apparatus as defined in claim 1 wherein the housing has a six-sided, box-like configuration.

6. The game apparatus as defined in claim 1 wherein the housing has a generally cylindrical configuration.

* * * * *